United States Patent [19]

Ninomiya

[11] 4,434,768

[45] Mar. 6, 1984

[54] AIR-FUEL RATIO CONTROL FOR INTERNAL COMBUSTION ENGINE

[75] Inventor: Masakazu Ninomiya, Kariya, Japan

[73] Assignee: Nippondenso Co., Ltd., Kariya, Japan

[21] Appl. No.: 397,874

[22] Filed: Jul. 13, 1982

[30] Foreign Application Priority Data

Jul. 15, 1981 [JP] Japan ..... 56-110386

[51] Int. Cl.[3] ..... F02M 51/00; F02M 23/04

[52] U.S. Cl. ..... 123/489; 123/492; 123/493; 123/589

[58] Field of Search ..... 123/440, 488, 585–589, 123/489, 492, 493; 364/431.05

[56] References Cited

U.S. PATENT DOCUMENTS

| | | | |
|---|---|---|---|
| 4,026,251 | 5/1977 | Schweitzer et al. | 123/419 |
| 4,064,846 | 12/1977 | Latsch et al. | 123/419 |
| 4,232,643 | 11/1980 | Leshner et al. | 123/486 |
| 4,368,707 | 1/1983 | Leshner et al. | 123/419 |

*Primary Examiner*—William A. Cuchlinski, Jr.
*Attorney, Agent, or Firm*—Cushman, Darby & Cushman

[57] ABSTRACT

In an air-fuel ratio control system for an engine, when the engine is driving at a specified operating condition such as an acceleration or deceleration condition, the air-fuel ratio is controlled at a stoichiometric air-fuel ratio. During a steady-state operating condition following the termination of the specified operating condition the air-fuel ratio is gradually changed from the stoichiometric air-fuel ratio to a leaner air-fuel ratio which provides the optimum fuel consumption and the air-fuel ratio for optimum fuel consumption is maintained until the engine again comes to the specified operating condition. The change to the optimum fuel consumption air-fuel ratio takes place immediately after the termination of the specified operating condition or after the expiration of a given time after the termination of the specified operating condition.

11 Claims, 7 Drawing Figures

| Tp \ N | ----- | N-1 | N | N+1 | N+2 | ----- |
|---|---|---|---|---|---|---|
| ⋮ | | | | | | |
| ⋮ | | | | | | |
| Tp-1 | | $K_4(Tp-1,N-1)$ | $K_4(Tp-1,N)$ | $K_4(Tp-1,N+1)$ | $K_4(Tp-1,N+2)$ | |
| Tp | | $K_4(Tp,N-1)$ | $K_4(Tp,N)$ | $K_4(Tp,N+1)$ | $K_4(Tp,N+2)$ | |
| Tp+1 | | $K_4(Tp+1,N-1)$ | $K_4(Tp+1,N)$ | $K_4(Tp+1,N+1)$ | $K_4(Tp+1,N+2)$ | |
| ⋮ | | | | | | |

AIR-FUEL RATIO CONTROL FOR INTERNAL COMBUSTION ENGINE

BACKGROUND OF THE INVENTION 1. Field of the Invention

The present invention relates to a method and apparatus for controlling the air-fuel ratio of a mixture supplied to an internal combustion engine in accordance with the operating conditions of the engine.

2. Description of the Prior Art

In the past, a method has been put to practical use in which a stoichiometric air-fuel ratio (the ratio of air and fuel supplied or A/F=about 15:1) is detected from the composition of the exhaust gases of an engine by an air-fuel ratio sensor positioned in the exhaust pipe of the engine and the air-fuel ratio to be supplied is controlled around the stoichiometric air-fuel ratio in accordance with the detection signal. This method provides a very effective method of purifying the exhaust gases if it is used in combination with a three-way catalyst.

From the standpoint of fuel consumption, however, generally it is advantageous to determine the air-fuel ratio greater than the stoichiometric ratio or use a mixture leaner than the stoichiometric mixture. The air-fuel ratio of this lean mixture that provides the optimum fuel consumption is referred to as the optimum air-fuel ratio. Methods have been devised for controlling the air-fuel ratio at around the optimum air-fuel ratio and this air-fuel ratio is very close to one which causes the engine to misfire thus giving rise to disadvantages that during the periods of acceleration and deceleration the air-fuel ratio is varied thereby causing the engine to misfire and increasing the breathing, deceleration shock or vibrations and so on.

SUMMARY OF THE INVENTION

It is the primary object of this invention to provide an air-fuel ratio control method and apparatus which covercome the foregoing deficiencies in the prior art and which make use of the advantages due to a given air-fuel ratio determined by an air-fuel ratio sensor and the optimum air-fuel ratio.

Thus, in accordance with the invention, during acceleration or deceleration, where the air-fuel ratio varies considerably and the amounts of NOx, HC and CO emissions in the exhaust gases are high, feedback control by an air-fuel ratio sensor is effected so as to maintain the air-fuel ratio at the given air-fuel ratio and thereby purify the harmful gases, e.g., NOx, HC and CO through a three-way catalyst. During the steady-state operation, the air-fuel ratio is feedback controlled at the optimum air-fuel ratio (hereinafter referred to as an optimum feedback control) thereby improving the fuel consumption. If a transition is made from controlling to the given air-fuel ratio to controlling to the optimum air-fuel ratio instantaneously upon transition from acceleration/deceleration to steady-state operation, the engine torque is decreased rapidly causing unpleasant shock to the vehicle. Thus, a transitional period is provided after the end of acceleration/deceleration during which period control gradually changes over from the given air-fuel ratio to the optimum air-fuel ratio, thereby preventing the occurrence of any unpleasant feeling due to any rapid decrease in engine torque. This air-fuel ratio control method has the effect of purifying the exhaust gases and improving the drivability and fuel consumption rate. While the transitional period may occur immediately after acceleration or deceleration, it may sometime occur at the expiration of a given time after the completion of acceleration or deceleration to enhance drivability and exhaust gas purification. Of course, this given time may be varied in accordance with the conditions of acceleration or deceleration.

DESCRIPTION OF THE PREFERRED EMBODIMENTS

To control the air-fuel ratio, a basic fuel injection quantity is first computed in accordance with the amount of inducted air and speed of the engine. For open loop control, this computed value is corrected by a correction amount $K_1$ corresponding to the cooling water temperature or the like. To feed back control the air-fuel ratio in response to the output of an air-fuel ratio sensor at a given air-fuel ratio such as the stoichiometric air-fuel ratio (hereinafter referred to as an A/F feedback control), the basic fuel injection quantity is corrected by a correction amount $K_2$ corresponding to the output of the air-fuel ratio sensor. When feedback control for optimum fuel consumption is effected, the basic fuel injection quantity is corrected by an optimum fuel consumption correction amount $K_4$ determined in accordance with the operating condition of the engine. During the transitional period, the fuel injection quantity is corrected by a correction amount $K_3$. The correction amount $K_3$ is not a factor having a fixed value but it is a variable which changes gradually from the valve of $K_2$ to the value of $K_4$, e.g., a variable which is corrected each time fuel is injected during the transitional period. As a result, if $T_p$ represents the basic fuel injection quantity or the basic pulse width of a control pulse for the fuel injector, then the pulse width T of the fuel injector control pulse is given by $T=T_p\times K_1\times K_2\times K_3\times K_4$. Note that $K_1=1$, $K_3=1$ and $K_4=1$ in the case of the A/F feedback control, $K_1=1$, $K_2=1$ and $K_3=1$ in the case of the optimum feedback control and $K_1=1$, $K_2=1$ and $K_4=1$ in the case of the transitional condition.

Figure 1:
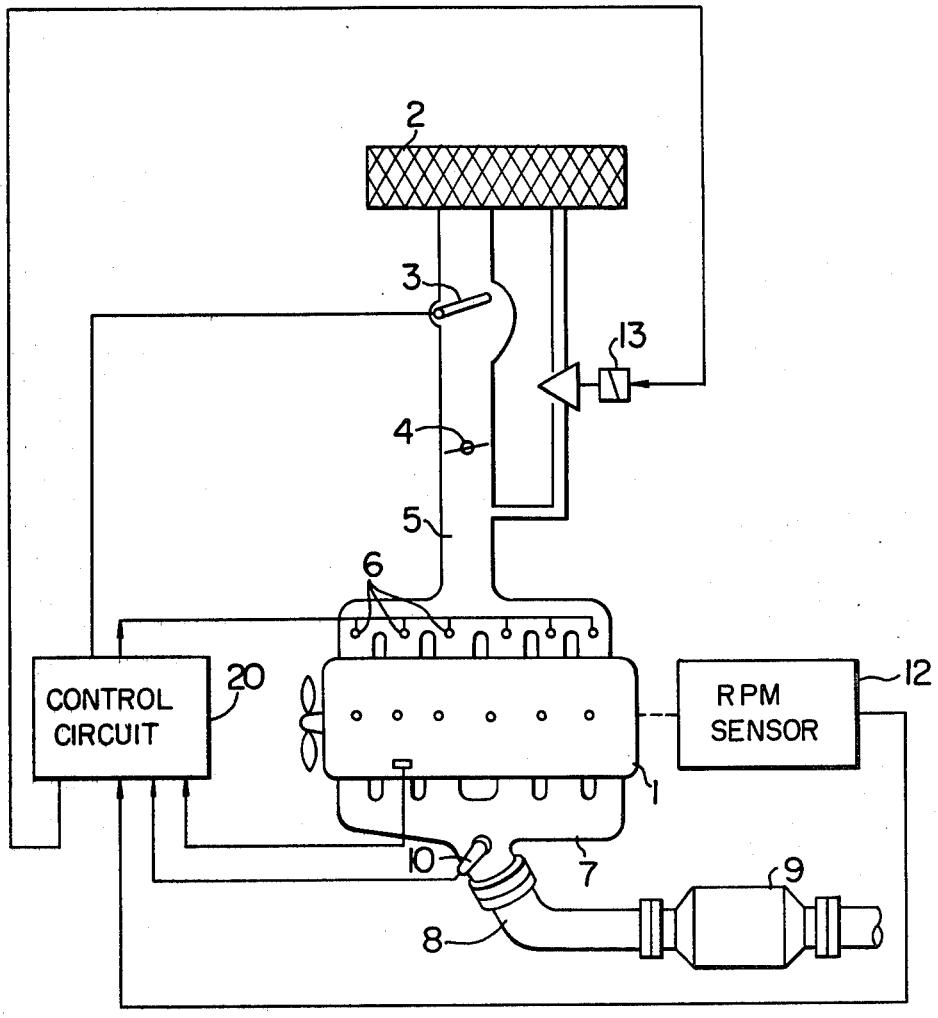
FIG. 1 is a schematic diagram showing the overall construction of an apparatus, which is useful for explaining embodiments of the present invention.

An embodiment of the invention will now be described with reference to the accompanying drawings. In FIG. 1, an engine 1 is a known type four-cycle spark ignition engine for installation in automobiles and the air for combustion is inducted by way of an air cleaner 2, an air flow sensor 3 which generates a voltage corresponding to the amount of air flow, a throttle valve 4 and an intake pipe 5. The fuel is supplied from a fuel system (not shown) by way of electromagnetic fuel injectors 6 which are provided one for each cylinder. The exhaust gases are discharged to the atmosphere via an exhaust manifold 7, an exhaust pipe 8 and a three-way catalytic converter 9. An air-fuel ratio or $O_2$ sensor 10 is positioned in the exhaust manifold 7. The air-fuel ratio sensor 10 detects the air-fuel ratio from the concentration of oxygen in the exhaust gases thereby generating, for example, a voltage of about 1 volt (high level) when the air-fuel ratio is small (rich) as compared with the stoichiometric ratio and a voltage of about 0.1 volt (low level) when the air-fuel ratio is large (lean) as compared with the stoichiometric ratio. This sensor may be replaced with an air-fuel ratio sensor for detecting an air-fuel ratio which is slightly leaner than the stoichiometric ratio or a lean sensor. A temperature sensor 11 is mounted in the engine 1 to detect the cooling water temperature. A speed sensor 12 detects the speed of the engine 1 to generate a pulse signal having a period corresponding to the crankshaft speed. A bypass valve 13 bypasses the air flow sensor 3 and the throttle valve 4 to control the flow of the air which is not measured.

A control circuit 20 is responsive to the detection signals from the sensors 3, 10, 11 and 12 to compute a basic fuel injection quantity and correction amounts $K_1$, $K_2$, $K_3$ and $K_4$ and compute a desired fuel injection quantity from the previously mentioned equation. The correction amounts $K_1$ and $K_2$ are computed from the known expressions. As will be described later, the predetermined values of the correction amount $K_4$ corresponding to the engine operating conditions are stored preliminarily so that the bypass valve 13 is opened and closed at intervals of a predetermined number of fuel injections and the resulting changes in the engine speed are utilized to determine from the air-fuel ratio at that time the direction of adjusting the air-fuel ratio to the optimum fuel consumption air-fuel ratio, thereby successively correcting the stored values in accordance with the determinations. The thus corrected values of the correction amount $K_4$ are stored in a nonvolatile RAM 107 which will be described later. As will be described later, the value of the correction amount $K_3$ is computed to change gradually from the correction amount $K_2$ to the correction amount $K_4$ and its value is corrected in response, for example, to each fuel injection during the transitional period.

Figure 2:
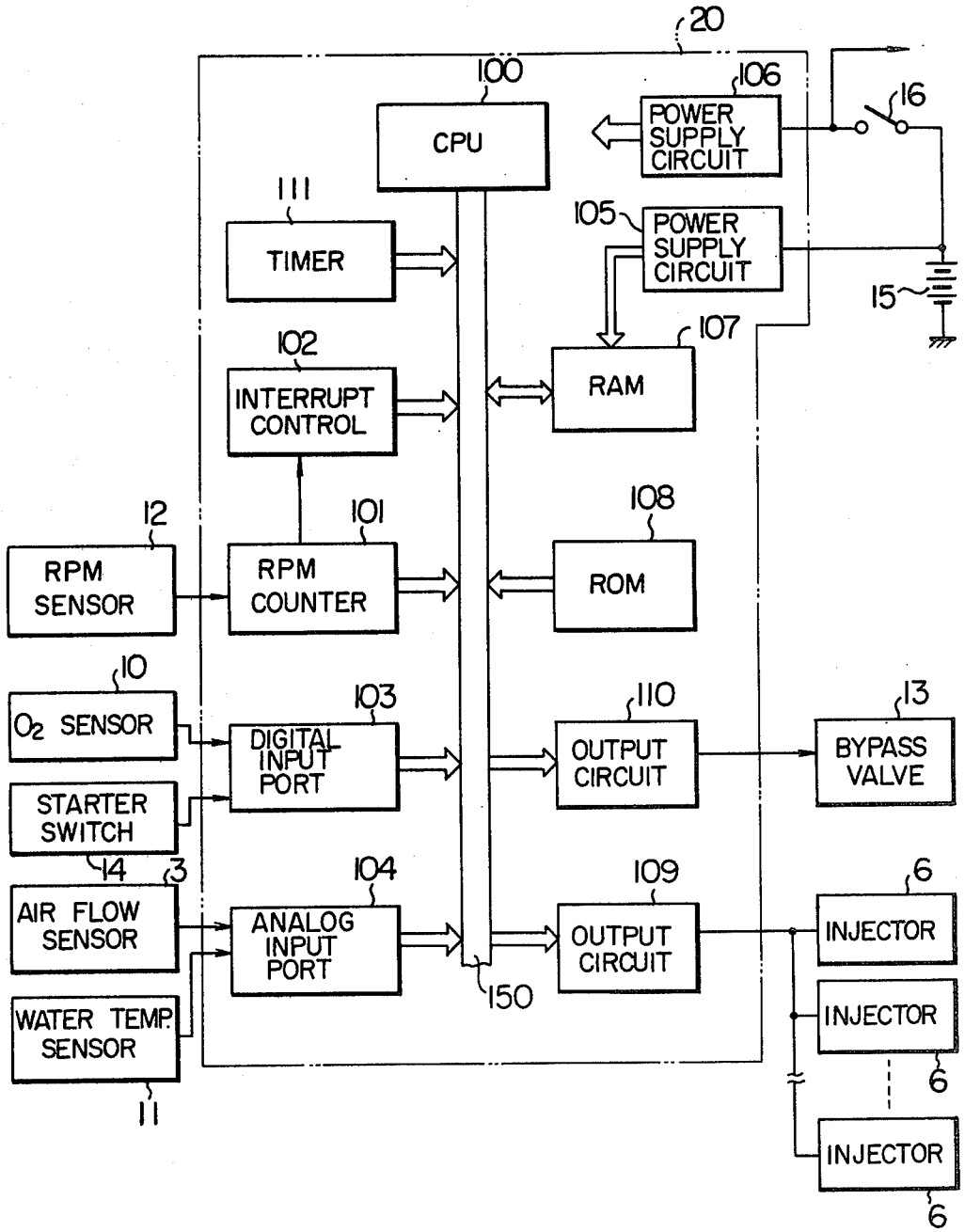
FIG. 2 is a block diagram of the control circuit shown in FIG. 1.
Figures 4, 6:
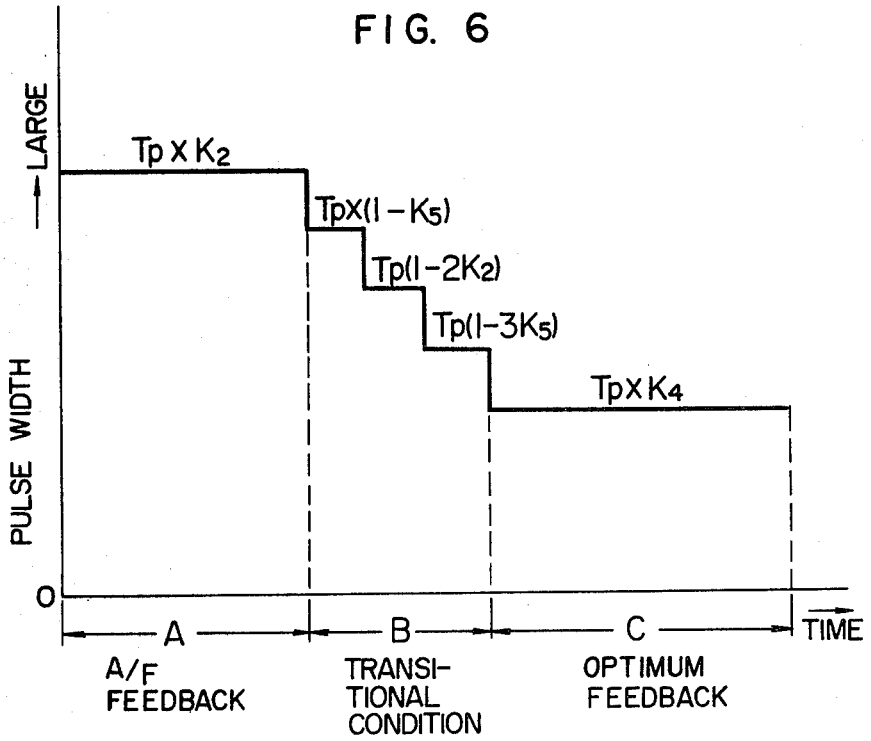
FIG. 4 shows a data map formed in the nonvolatile RAM shown in FIG. 2 to store the values of a correction amount $K_4$.
FIG. 6 is a diagram showing variations in the pulse width of an electromagnetic fuel injector control pulse which is computed in accordance with the operating conditions.

Next, the control circuit 20 will be described with reference to FIG. 2. Numeral 100 designates a microprocessor (or CPU) for computing the quantity of fuel to be injected. Numeral 101 designates an engine speed counter for measuring the engine speed in response to the signals from the speed sensor 12. Numeral 103 designates digital input ports for transmitting to the microprocessor 100 digital signals including the signal from the air-fuel ratio sensor 10, the starter signal from a starter switch 14 for turning on and off the starter switch which is not shown, etc. Numeral 104 designates analog input ports including a multiplexer and an A-D converter and serving the function of successively subjecting the signals from the air-flow sensor 3 and the water temperature sensor 11 to A-D conversion and reading the same into the microprocessor 100. The output data from the units 101, 102, 103 and 104 are transmitted to the microprocessor 100 by way of the common bus 150. Numeral 105 designates a power supply circuit for supplying power to the RAM 107 which will be described later. Numeral 15 designates a battery, and 16 a key switch of the automobile. The power supply circuit 105 is connected to the battery 15 directly and not through the key switch 16. As a result, the power is always applied to the RAM 107 which will be described later irrespective of the key switch 16. Numeral 106 designates another power supply circuit connected to the battery 15 through the key switch 16. The power supply circuit 106 supplies the power to the component parts other than the RAM 107. The RAM 107 is a read/write memory unit which is used temporarily during the time that a program is in operation and it forms a non-volatile memory so designed that the power is always applied to it irrespective of the key switch 16 and its stored contents are not lost even if the key switch 16 is turned off thereby stopping the operation of the engine. The values of the correction amount $K_4$ shown in FIG. 4 are also stored in the RAM 107. Numeral 108 designates a read only memory (ROM) storing a program, various constants, etc. An output circuit 109 comprises a latch, a down counter, a power transistor etc., whereby a digital signal indicative of the opening duration of the injectors 6 or the fuel injection quantity computed by the microprocessor 100 is converted to a pulse signal having a pulse width which provides the actual opening duration of the injectors 6 and the pulse signal is applied to the injectors 6. An output circuit 110 comprises a latch, a power transistor, etc., and is responsive to the result of a computation made by the CPU 100 on the basis of its input signals to generate and apply an ON or OFF control signal to the electromagentic bypass valve 13. A timer 111 is a circuit for generating clock pulses and measuring the elapsed time and it applies clock signals to the CPU 100 and a time interrupt signal to the interrupt control unit 102.

The counter 101 is responsive to the output of the speed sensor 12 to measure the engine speed once for every engine revolution and supply an interrupt command signal to the interrupt control unit 102 upon completion of each measurement. In response to the applied signal, the interrupt control unit 102 generates an interrupt request signal and causes the microprocessor 100 to execute an interrupt processing routine for the computation of fuel injection quantity.

Figure 3:
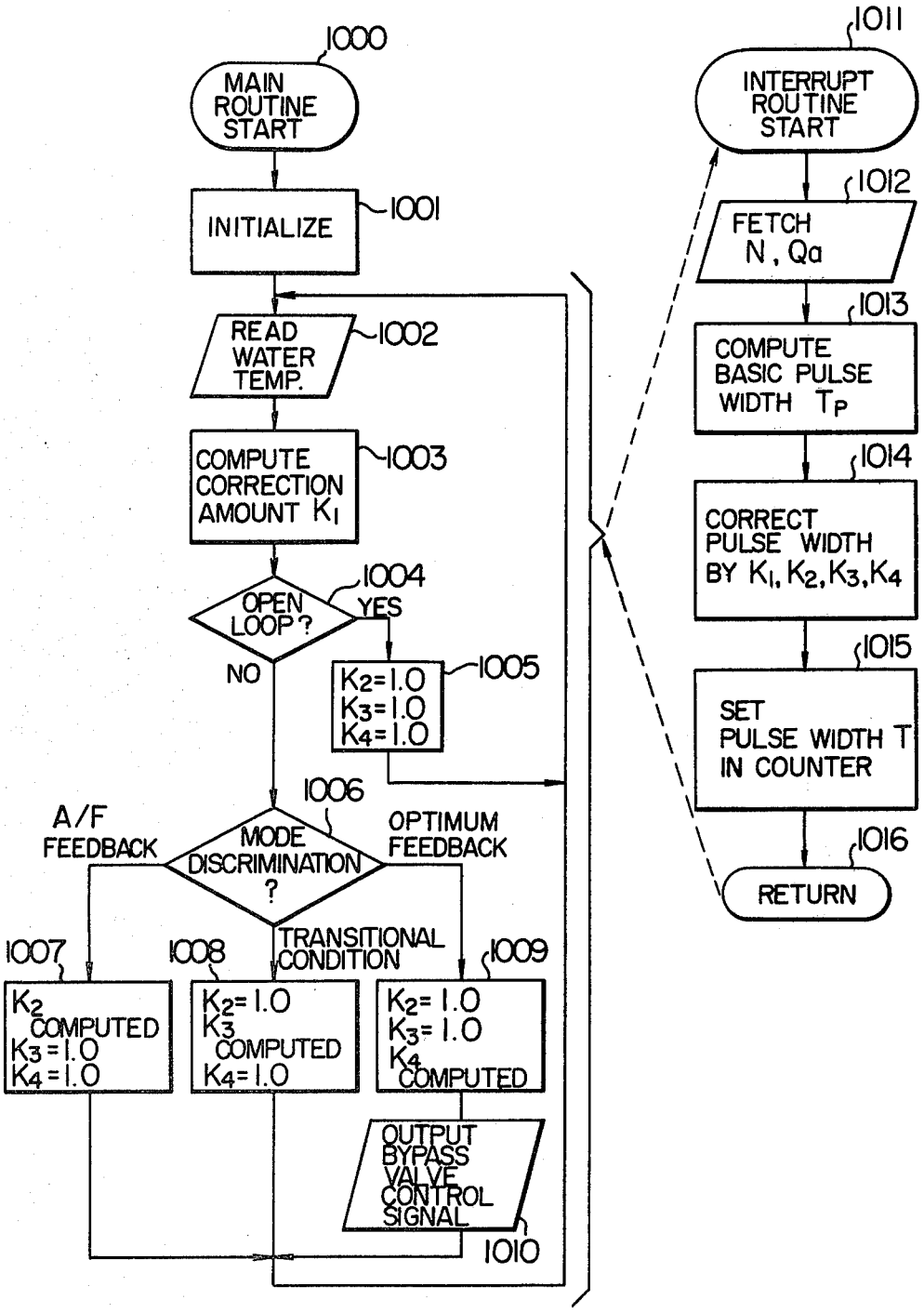
FIG. 3 is a simplified flow chart of the operations performed by the microprocessor shown in FIG. 2.

In FIG. 3, when the key switch 16 and the starter switch 14 are turned on so that the engine is started, the first step or a start stepp 1000 initiates the computational operations of a main routine so that a step 1001 performs the operation of initialization and a step 1002 reads in a digital value corresponding to the cooling water temperature from the analog input ports 104. In response to the result of the step 1002, a step 1003 computes a correction amount $K_1$ from the known expression and stores the result in the RAM 107.

A step 1004 determines whether an open loop control is to be effected in accordance with the cooling water temperature and the condition of the air-fuel ratio sensor 10. If the cooling water temperature is below 60° C. and the air-fuel ratio sensor 10 is not in the activated condition, it is determined that the control mode is an open loop control mode where no A/F feedback control and no optimum feedback control are performed, so that the step 1004 branches to YES and a step 1005 sets all the correction amounts $K_2$, $K_3$ and $K_4$, other than $K_1$, to 1.0, that is, a condition is established where the corrections other than one corresponding to the cooling water temperature are prevented, thereby making a return to the step 1002.

If the cooling water temperature is above 60° C. and the sensor 10 is in the activated condition, the step 1004 branches to NO and a step 1006 determines whether the operating mode is the A/F feedback control mode, the optimum feedback control mode or the transitional mode. In this case, the correction amount $K_1$ is set to 1.0. If the difference between the current air flow and that of 0.2 seconds before, for example, is greater than 20 $m^3$/hr, it is determined that the vehicle is at the acceleration or deceleration operating condition and so that A/F feedback control is to be effected. Where an intake pressure sensor is used, the existence of the similar condition is determined when the difference between the current intake pressure and the intake pressure of 0.2 seconds before, for example, is 100 mmHg. While it may be arranged so that the A/F feedback control is completed just upon termination of the acceleration or deceleration operation, there are cases where even after termination of the acceleration or deceleration operation the exhaust emission control must be effected through the air-fuel ratio sensor depending on the operating conditions of the engine and where the A/F feedback control must be effected during a given time period after the termination of the acceleration or deceleration operation from the standpoint of improving the drivability. In the description to follow, it is assumed that the A/F feedback control is effected even during a predetermined time after the termination of the acceleration or deceleration operation. In this case, it is determined that the A/F feedback control must still be effected until the predetermined time (e.g., 10 seconds) expires after the termination of the condition where the intake air flow difference of over 20 $m^3$/hr (or the intake presssure difference of 100 mmHg) is present. This predetermined time may be fixed or it may be varied in accordance with the operating conditions. If it is determined that the A/F feedback control must be effected, a transfer is made to a step 1007. When the predetermined time expires, it is determined that the vehicle is at the transitional condition and a transfer is made to a step 1008. The step 1008 performs the computation of correction amount $K_3$ as will be described later and upon termination of the time required for the computation of $K_3$ it is determined that the condition is now such that the optimum feedback control must be effected thus transferring to a step 1009.

In response to the output signal of the air-fuel ratio sensor 10 inputted from the digital input ports 103, the step 1007 computes the correction amount $K_2$ or integrated correction factor as a function of the elapsed time measured by the timer 111 from the known expression. In this case, the correction amounts $K_3$ and $K_4$ are set to 1.0.

The step 1008 computes the correction amount $K_3$ from an expression $K_3=K_2(1-n\times K_5)$. Here, n is the number of fuel injections after the start of the transitional condition or after the expiration of the predetermined time and $K_5$ is a correction factor per fuel injection which is stored at a predetermined addressable location of the ROM 108. The computation of $K_3$ is completed when the $K_2(1-n\times K_5)$ becomes equal to the correction amount $K_4$ successively corrected and stored in the previously-mentioned manner. In this case, the correction amounts $K_2$ and $K_4$ are set to 1.0 with respect to the correction of the fuel injection quantity. The correction factor $K_5$ may be a fixed value or a variable value. If it is a variable value, it is possible, for example, to correct the fuel injection quantity gradually during the early part of the transitional period and correct the fuel injection quantity rapidly during the later half of the period.

The step 1009 performs the computation of correction amount $K_4$ which will be described later.

In the optimum feedback control mode, the amount of air flow which is not measured by the air flow sensor 3 is controlled by opening and closing the bypass valve 13 to vary the air-fuel ratio and the resulting changes in the engine speed are detected thereby determining the direction of correcting the air-fuel ratio to attain the optimum air-fuel ratio. In this case, while the fuel injection quantity is of course changed by the correction amount $K_4$ for obtaining the optimum fuel consumption, during the steady-state operating condition the amount of change of the fuel injection quantity is small and thus the change of the air-fuel ratio due to the change of the fuel injection quantity is almost negligibly small as compared with the change of the air-fuel ratio due to the control of the air flow through the bypass valve 13. As a result, the fuel injection quantity can be assumed practically constant in determining the direction of correcting the air-fuel ratio to obtain the optimum air-fuel ratio. If the air-fuel ratio is varied with the fuel injection quantity maintained constant, that direction which increases the engine speed is the direction of improving the fuel consumption.

The RAM 107 includes a data map comprising engine speeds N and basic pulse widths $T_p$ which can be approximated to intake pressures and the desired values of the correction amount $K_4$ which were determined as the result of the previously effected optimum feedback control operations are stored in the data map in correspondence to the respective operating conditions. If no optimum feedback control has been effected so far, the stored values are 1.0. The stored values of $K_4$ are successively corrected in accordance with changes in the engine speed caused by the opening and closing of the bypass valve 13 and the corrected values of $K_4$ are stored in place of the previously stored values. In FIG. 4, N, N+1, N−1, . . . indicate the locations corresponding to the engine speeds and $T_p$, $T_p+1$, $T_p-1$, . . . indicate the locations corresponding to the basic pulse widths. For example, the correction amount $K_4(T_p, N)$ corresponding to the operating condition represented by the engine speed corresponding to the location N and the basic pulse width corresponding to the location $T_p$ is stored at the location designated by the locations N and $T_p$.

Figure 5:
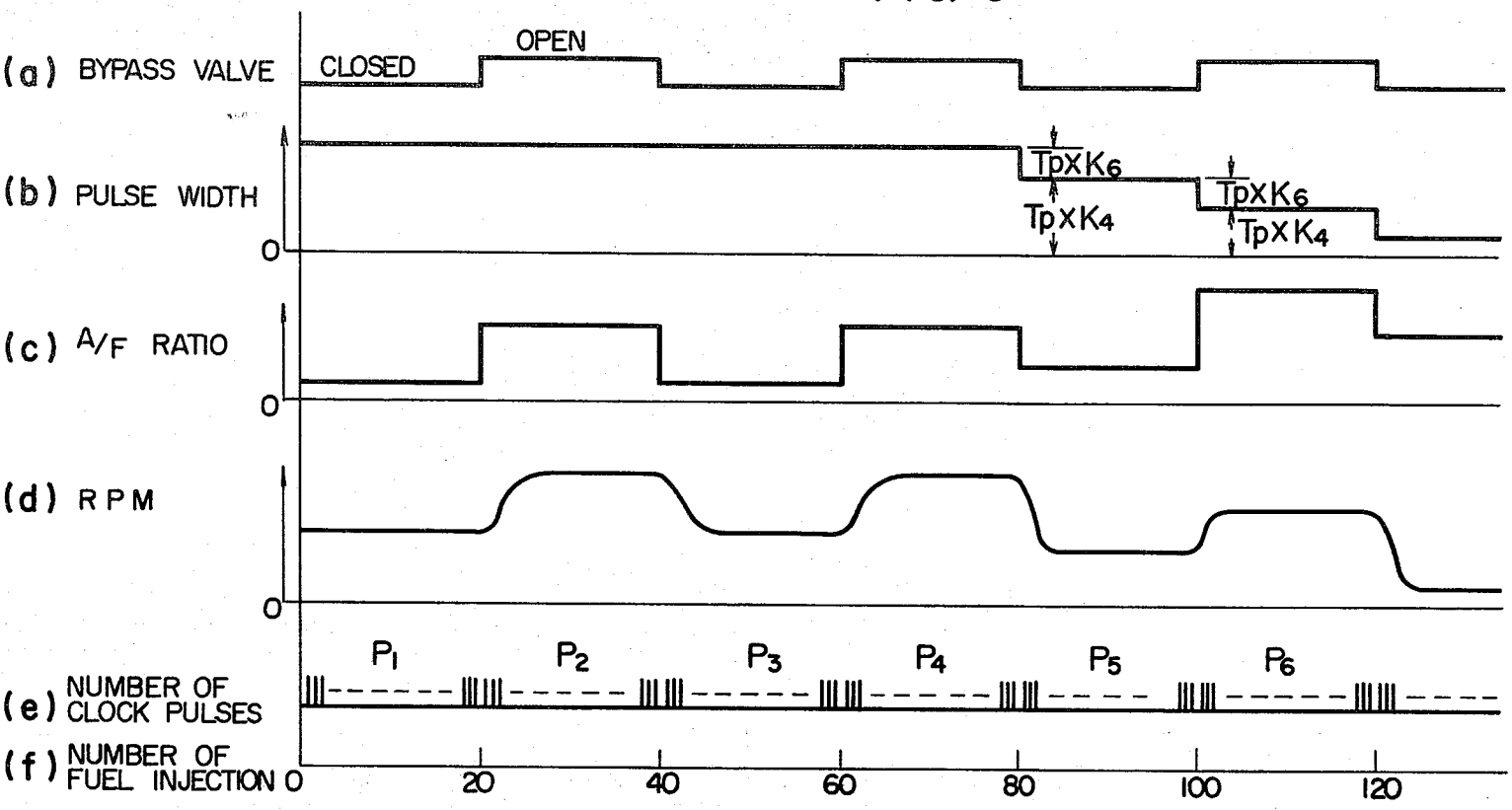
FIG. 5 is a time chart for explaining the feedback control for optimum fuel consumption.

Next, the computation for correcting the correction amount $K_4$ will be described with reference to FIG. 5. FIG. 5 is a time chart showing the manner in which the optimum feedback control is effected, and shown in (a) of FIG. 5 is the manner in which the bypass valve 13 is opened and closed, respectively, each time the number of fuel injections shown in (f) reaches 20, with the high level showing the open condition and the low level showing the closed condition. (b) shows the pulse width T of the control pulse for the fuel injectors 6 and the manner in which the pulse width T is varied in response to the correction by $K_4$ at the time that the number of fuel injections reaches 80, 100 and 120, respectively. Shown in (c) is the manner that the air-fuel ratio is varied in response to the opening and closing of the bypass valve 13 and the changes in the pulse width T, that is, the manner in which the air-fuel ratio is varied only in response to the opening and closing of the bypass valve 13 until the number of fuel injections reaches 80 but after reaching 80 the air-fuel ratio is varied in response to both the opening and closing of the bypass valve 13 and the changes in the pulse width T. Shown in (d) is the manner in which the engine speed is varied in correspondence to the changes in the air-fuel ratio, and shown in (e) are the numbers of clock pulses counted for the open and closed times of the bypass valve 13, with $P_1$ for example showing the number of pulses for the interval during which the number of fuel injections increases from 0 to 20.

With the numbers of clock pulses counted during the intervals which are divided in steps of 20 fuel injections, the direction of correction to the optimum air-fuel ratio is determined in accordance with the numbers of clock pulses for the latest four intervals. If the number of clock pulses increases (the engine speed decreases) when the bypass valve 13 is closed and the number of clock pulses decreases (the engine speed increases) when the bypass valve 13 is opened, it is determined that the fuel consumption can be improved by adjusting the air-fuel ratio leaner. In the reverse case, the fuel consumption can be improved by adjusting the air-fuel ratio richer. In accordance with such determinations, the stored values $K_4$ written in correspondence to the engine operating conditions in the data map based on the engine speeds and the basic pulse widths substituting for the engine loads as shown in FIG. 4 are corrected through the following computation. In other words, $K_4=K_4'-K_6$ is computed for adjusting the air-fuel ratio leaner and $K_4=K_4'+K_6$ is computed for adjusting the air-fuel ratio richer. Here, $K_6$ represents the correction amount per one correction and $K_4'$ represents the stored value of $K_4$ previously written in the data map.

For instance, at the time that the number of fuel injections is reaching 80 in FIG. 5, there is a relationship $P_1>P_2<P_3>P_4$ between the number of clock pulses $P_1$ and $P_3$ for the closed times of the bypass valve 13 and the numbers of clock pulses $P_2$ and $P_4$ for the open times in FIG. 5 and thus $K_4=K_4'-K_6$ is computed. Then, contrary to the case of FIG. 5, if there is a relationship $P_1<P_2>P_3<P_4$, $K_4=K_4'+K_6$ is computed. Also, at the time that the number of fuel injections is reaching 100 in FIG. 5, the relationship between the numbers of clock pulses $P_2$, $P_3$, $P_4$ and $P_5$ corresponding to the latest four intervals becomes $P_2<P_3>P_4<P_5$ and thus the engine speed also increases when the bypass valve is open. As a result, $K_4=K_4'-K_6$ is computed. The values of K corrected by such computations are successively stored in place of the stored values written previously in the data map of FIG. 4. Since, in the case of the optimum fuel consumption feedback control, the pulse width T of the control pulse is given by $T=T_p\times K_4$ as will be described later and since the value of $K_4$ is corrected by decreasing it by $K_6$ for every 20 fuel injections, the pulse width T is corrected as shown in (b) of FIG. 5. If the relationship between the numbers of clock pulses is other than those mentioned above, the correction of $K_4$ is not effected. When the relationship is other than those mentioned above, it is an indication that the vehicle is at a special operating condition, e.g., the accelerator pedal is being depressed or the vehicle is descending a slope and consequently the correction of $K_4$ has no significance. Note that in addition to the air-fuel ratio sensor, attempts have been made to realize the practical use of a lean sensor for detecting a leaner air-fuel ratio than stoichiometric ratio (e.g., A/F=17-20) and it is possible to use this lean sensor such that the optimum air-fuel ratio is monitored and the correction of $K_4$ through the lean sensor is effected in addition to the correction of $K_4$ in response to the opening and closing of the bypass valve 13.

The computation of $K_4$ by the step 1009 is effected in the above-described manner and in this case the correction amounts $K_2$ and $K_3$ are set to 1.0. The values of the correction amounts $K_1$, $K_2$, $K_3$ and $K_4$ set or computed in the above-described manner are also successively stored at the respective addressable locations of the RAM 107 in place of the previously stored ones.

After the completion of these computations, a step 1010 applies a signal for changing the closed or open condition of the bypass valve to the output circuit 110 at intervals of 20 fuel injections.

Usually, the microprocessor 100 repeatedly executes the processing of the main routine comprising from the step 1002 to the step 1010. When an interrupt request signal is applied from the interrupt control unit 102, even if the main routine is being executed, the microprocessor 100 immediately interrupts the execution of the main routine and proceeds to the interrupt processing routine of a step 1011.

A step 1012 inputs a signal indicative of the engine speed N from the engine speed counter 101 and a signal indicative of the intake air amount $Q_a$ from the analog inputs 104 and stores them in the RAM 107.

Then, a step 1013 computes from the engine speed N and the intake air amount $Q_a$ a basic fuel injection quantity or a basic pulse width $T_p$ of the control pulse for the fuel injectors 6. The computation is based on an expression $T_p=F\times Q_a/N$ (where F is a constant).

A step 1014 corrects the pulse width T of the control pulse in accordance with the correction amounts $K_1$, $K_2$, $K_3$ and $K_4$ computed by the main routine. The computation is made from the expression $T=T_p\times K_1\times K_2\times K_3\times K_4$.

A step 1015 sets the computed pulse width T in the counter of the output circuit 109. Then, a transfer is made to a step 1016 and the processing is returned to the main routine. When the processing is returned to the main routine, the return is made to the processing step which was interrupted by the interrupt processing. The microprocessor 100 functions as described hereinabove.

FIG. 6 shows the manner in which the computed pulse width T is varied. FIG. 6 shows by way of example a case where the vehicle is first accelerated or decelerated and then it is operated in a steady-state condition. In the Figure, the interval A indicates, for example, the acceleration period and the following predetermined time and during the interval the A/F feedback control is effected. In this case, the pulse width T is given by $T=T_p\times 1\times K_2\times 1\times 1=T_p\times K_2$. The interval B is the transitional period after the expiration of the predetermined time and the pulse width T is given by $T=T_p\times 1\times 1\times K_3\times 1=T_p\times K_3$. Since $K_3$ is given by $K_3=K_2\,(1-n\times K_5)$ as mentioned previously and since $K_2=1$, the pulse width T is changed to $T=T_p\,(1-K_5)$, $T=T_p\,(1-2K_5)$, $T=T_p\,(1-3K_5)$, . . . in response to the successive fuel injections. While FIG. 6 shows the case where $K_5$ is a fixed value, if it is a variable value, the resulting stepwise variation of the pulse width T during the interval B differs from the illustrated one. The interval C indicates one where the optimum feedback control is effected after the expiration of the transitional period and the pulse width T is given by $T=T_p\times 1\times 1\times 1\times K_4=T_p\times K_4$.

Figure 7:
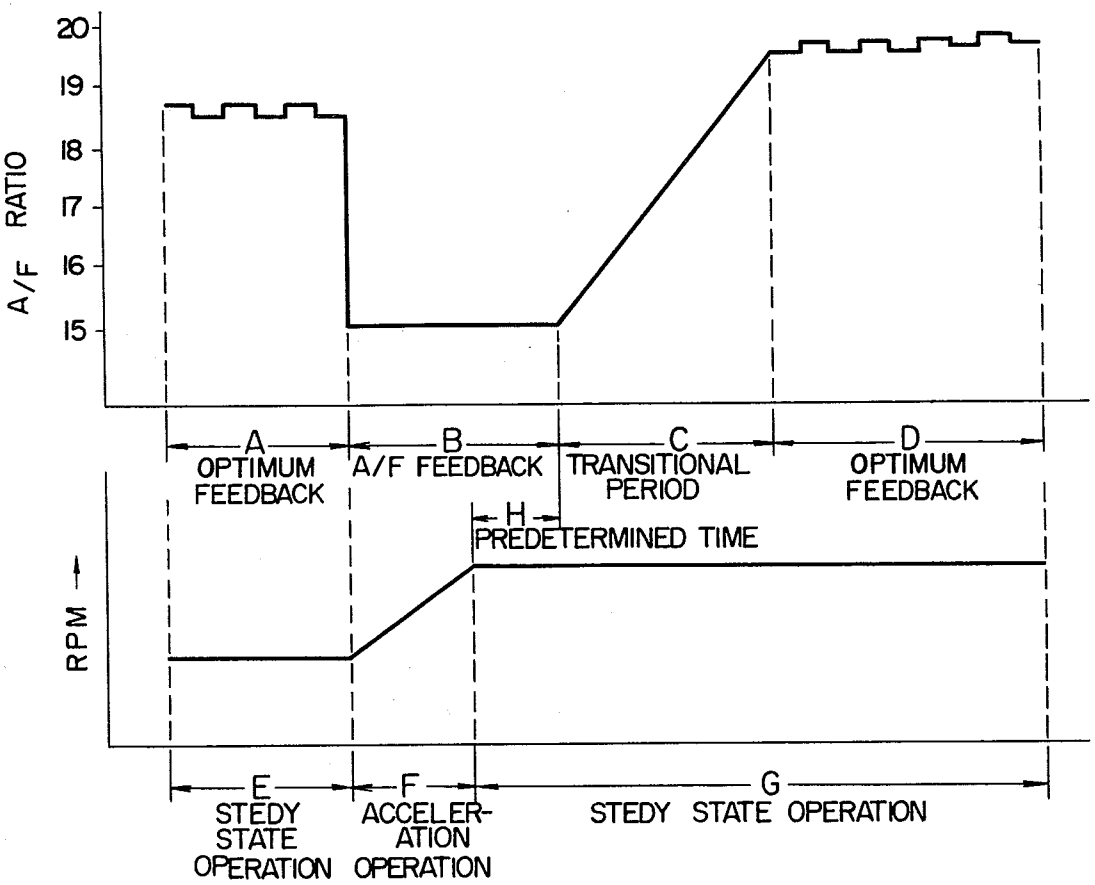
FIG. 7 is a diagram showing the relationship between the engine speed and the air-fuel ratio and the operating conditions.

FIG. 7 shows the relationship between the engine speed and the air-fuel ratio during the optimum feedback control period, the A/F feedback control period and the transitional period. FIG. 7 shows the case where the vehicle at the steady-state operation is brought to the accleration operation and it is again brought to the steady-state operation. The intervals A, B, C and D respectively indicate the optimum feedback control period, the A/F feedback control period, the transitional period and the optimum feedback control period. The intervals E, F and G respectively indicate the first steady-state operation period, the acceleration operation period and the second steady-state operation period. Designated at H is the predetermined time after the completion of the acceleration operation. At the first steady-state operation E the air-fuel ratio is corrected by the correction amount $K_4$ stored in the data map of FIG. 4 as the result of the previous operation and the vehicle is operated at the air-fuel ratios leaner than the stoichiometric ratio as shown in the interval A. When the vehicle driver depresses the accelerator pedal so that the vehicle is accelerated, the A/F feedback control is effected during the acceleration period F and the predetermined time H after the acceleration and the air-fuel ratio is maintained at the stoichiometric ratio as shown in the interval B. Then, in the condition of the second steady-state operation G the vehicle comes to the transitional operation and thus the air-fuel ratio is corrected by the correction amount $K_3$ for every fuel injection until it is changed from the stoichiometric ratio to the optimum fuel consumption ratio as shown in the interval G. When the computation of the correction amount $K_3$ causes the value of $k_3$ to reach the correction amount $K_4$ stored in the data map of FIG. 4, the optimum feedback control is again effected as shown in the interval D. In this case, the engine speed increases as compared with the first steady-state operation so that the basic pulse width $T_p$ of the control pulse is decreased and the air-fuel ratio is adjusted leaner as compared with the first steady-state operation.

From the foregoing it will be seen that during the acceleration or deceleration operation the air-fuel ratio is maintained at the stoichiometric ratio thereby solving the problems of drivability and exhaust emissions during the acceleration or deceleration, during the steady-state operation the air-fuel ratio is controlled at one which provides the optimum fuel consumption thereby improving the fuel consumption, and when changing the air-fuel ratio from the stoichiometric ratio to the optimum fuel consumption ratio the air-fuel ratio is changed gradually thereby improving the drivability during the transition from the acceleration or deceleration operation to the steady-state operation. While the amount of change of the fuel injection quantity at each correction by the correction amount $K_4$ is small, the fuel consumption can be improved considerably over a long period of steady-state operation.

While, in the above-described embodiment, during the acceleration or deceleration operation the air-fuel ratio is maintained at the stoichiometric ratio, the air-fuel ratio sensor 10 may be comprised of a lean sensor so as to maintain the air-fuel ratio of the mixture at a slightly greater ratio than the stoichiometric ratio. Further, which the air-fuel ratio is varied as a function of the number of fuel injections, it may be varied as a function of time.

I claim:

1. A method for controlling an air-fuel ratio comprising the steps of:

detecting whether a predetermined engine operating condition exists;

detecting a relationship between an acutal air-fuel ratio and a predetermined air-fuel ratio different from an air-fuel ratio providing optimum fuel consumption with an oxygen sensor exposed to exhaust gases;

maintaining, when said predetermined operating condition of said engine is detected, the air-fuel ratio at said predetermined air-fuel ratio at least during said predetermined operating condition;

changing gradually, during a steady-state operating condition after the termination of said predetermined operating condition, the air-fuel ratio from said predetermined air-fuel ratio to said air-fuel ratio providing an optimum fuel consumption; and maintaining said optimum fuel consumption providing air-fuel ratio until said predetermined operating condition is detected again.

2. A method according to claim 1, wherein said gradual change to said optimum fuel consumption providing air-fuel ratio is effected immediately after the termination of said predetermined operating condition.

3. A method according to claim 1, wherein said gradual change to said optimum fuel consumption providing air-fuel ratio is effected when a predetermined time expires after the termination of said predetermined operating condition.

4. A method according to claim 1, 2 or 3, wherein said gradual change to said optimum fuel consumption providing air-fuel ratio is effected changing the air-fuel ratio at a gradually increasing rate of change.

5. A method according to claim 4, wherein said gradual change to said optimum fuel consumption providing air-fuel ratio is effected by changing the air-fuel ratio in a stepwise manner.

6. A method according to claim 1, wherein said step of maintaining said optimum fuel consumption providing air-fuel ratio includes the steps of repeatedly increasing the amount of air at intervals of a predetermined time period, detecting a change in the speed of said engine during said time period for increasing the amount of air and a change in the speed of said engine during a time period other than said time period for increasing the amount of air, and changing the amount of fuel in accordance with said detected changes in the speed of said engine.

7. An apparatus for controlling an air-fuel ratio comprising:

air supply means for suppying air to an engine;

sensor means for detecting whether at least a predetermined engine condition exists;

oxygen sensing means, exposed to exhaust gases, for detecting a relationship between an actual air-fuel ratio and a predetermined air-fuel ratio different from an air-fuel ratio providing optimum fuel consumption to generate an output signal corresponding to said detected relationship;

processor means responsive to said sensor means for determining whether said engine is at said specified operating condition or a steady-state operating condition and for performing a computation for maintaining the air-fuel ratio of the mixture at said predetermined air-fuel ratio in accordance with the output signal from said oxygen sensing means when it is determined that said engine is at said predetermined operating condition, a computation for gradually changing the air-fuel ratio of the mixture from said predetermined air-fuel ratio to said air-fuel ratio providing an optimum fuel consumption when it is determined that said engine is at said steady-state operating condition and a computation for maintaining said optimum fuel consumption providing air-fuel ratio until it is determined that said engine is again at said predetermined operating condition;

a read/write memory for storing the results of the computations of said processor means at respective addressable locations thereof; and fuel supply means for supplying fuel to be mixed with air supplied by said air supply means in accordance with the results of the computations of said processor means.

8. An apparatus for controlling an air-fuel ratio comprising:

air supply means for suppling air to said engine; p1 sensor means for detecting whether at least a predetermined engine condition exists;

oxygen sensing means, exposed to exhaust gases, for detecting a relationship between an actual air-fuel ratio and a predetermined air-fuel ratio different from an air-fuel ratio providing optimum fuel consumption to generate an output signal corresponding to said detected relationship;

processor means responsive to said sensor means for determining whether said engine is at said predetermined operating condition or a steady-state operating condition and determine whether a predetermined time has expired after the termination of said predetermined operating condition and for performing a computation of controlling the air-fuel ratio at said predetermined air-fuel ratio in accordance with the output signal of said detecting means when it is determined that either said engine is at said predetermined operating condition or said predetermined time has not expired, a computation for gradually changing the air-fuel ratio from said predetermined air-fuel ratio to said air-fuel ratio providing an optimum fuel consumption when it is determined that said engine is at said steady-state operating condition after the termination of said predetermined time and a computation for maintaining said optimum fuel consumption providing air-fuel ratio until it is determined that said engine is again at said predetermined operating condition;

a read/write memory for storing the results of the computations of said processor means at respective addressable locations thereof; and fuel supply means for supplying fuel to be mixed with air supplied from said air supply means in accordance with the results of the computations of said processor means.

9. An apparatus according to claim 7 or 8, further comprising a read-only memory for storing a fixed value of a correction factor at a pretermined addressable location thereof, wherein said processor means includes a computing section for successively performing a computing for correcting the air-fuel ratio in accordance with said correction factor to effect said gradual change to said optimum fuel consumption providing air-fuel ratio.

10. An apparatus according to claim 7 or 8, further comprising a read-only memory for storing different values of a correction factor at a predetermined addressable location thereof, wherein said processor means includes a computing section for successively performing a computation for correcting the air-fuel ratio in accordance with a minimum value to successive large values of said correction factor to effect said gradual change to said optimum fuel consumption providing air-fuel ratio.

11. An apparatus according to claim 7 or 8, wherein:

said apparatus further comprises:

bypass means opened and closed at a predetermined period such that air bypasses said air supply means so as not to be measured by a sensor included in said sensor means which detects an intake condition of said engine, said air through said bypass means being supplied to said engine at said predetermined period, and another detecting means for detecting a change in the speed of said engine during each of the open and closed times of said bypass means; and said processor means includes a computing section for performing a computation for changing the amount of fuel in accordance with said detected engine speed changes so as to maintain said optimum fuel consumption providing air-fuel ratio.

* * * * *